United States Patent [19]

Brands et al.

[11] Patent Number: 5,039,362

[45] Date of Patent: Aug. 13, 1991

[54] TITANIUM FREE COMPOSITION AND PROCESS FOR ACTIVATING METAL SURFACES PRIOR TO ZINC PHOSPHATING

[75] Inventors: Karl-Dieter Brands; Helmut Endres; Peter Christophliemk, all of Duesseldorf; Wolf-Achim Roland, Solingen, all of Fed. Rep. of Germany

[73] Assignee: Henkel Kommanditgesellschaft auf Aktien, Duesseldorf, Fed. Rep. of Germany

[21] Appl. No.: 344,883

[22] Filed: Apr. 28, 1989

[30] Foreign Application Priority Data

Apr. 28, 1988 [DE] Fed. Rep. of Germany ..... 3814363

[51] Int. Cl.[5] ..... C23C 22/17

[52] U.S. Cl. ..... 148/254; 148/262; 562/21; 562/13

[58] Field of Search ..... 562/21, 13; 148/254

[56] References Cited

U.S. PATENT DOCUMENTS

| | | | |
|---|---|---|---|
| 2,164,024 | 6/1939 | Schneider et al. . | |
| 2,310,239 | 2/1943 | Jernstedt . | |
| 2,456,947 | 12/1948 | Jernstedt . | |
| 2,462,196 | 2/1949 | Jernstedt . | |
| 3,141,804 | 7/1964 | Gold et al. . | |
| 3,547,711 | 12/1970 | Ashdown | 148/6.15 |
| 3,686,145 | 8/1972 | Haschke et al. | 260/67 |
| 3,793,222 | 2/1974 | Haschke et al. | 260/67 |
| 3,896,086 | 7/1975 | Haschke et al. | 260/67 |
| 3,923,742 | 12/1975 | Haschke et al. | 260/67 |
| 4,266,677 | 5/1981 | Müller et al. | 148/6.15 |
| 4,384,900 | 5/1983 | Gotta et al. | 148/6.15 |

FOREIGN PATENT DOCUMENTS

| | | |
|---|---|---|
| 0056675 | 7/1982 | European Pat. Off. . |
| 2931712 | 8/1983 | Fed. Rep. of Germany . |
| 1296412 | 11/1972 | United Kingdom . |

*Primary Examiner*—Sam Silverberg

*Attorney, Agent, or Firm*—Ernest G. Szoke; Wayne C. Jaeschke; Norvell E. Wisdom, Jr.

[57] ABSTRACT

Effective, titanium-free agents for activating metal surfaces prior to phosphating these surfaces with phosphating baths containing zinc ions can be made by reacting alkali metal phosphates with 1,1-diphosphonic acids and their alkali metal salts and/or poly(aldehydocarboxylic acids) and their alkali metal salts.

14 Claims, No Drawings

TITANIUM FREE COMPOSITION AND PROCESS FOR ACTIVATING METAL SURFACES PRIOR TO ZINC PHOSPHATING

FIELD OF THE INVENTION

The invention relates to titanium free compositions having increased efficiency for the activation of surfaces of iron, steel, zinc, galvanized iron or steel, aluminum, its alloys, and steel coated with aluminum or its alloys prior to phosphating said surfaces with phosphating baths containing zinc ions, and more particularly prior to so-called low-zinc phosphating wherein the ratio of zinc ions to phosphate ions in the treatment solution is less than 1:12. The invention also relates to processes utilizing its novel compositions.

STATEMENT OF RELATED ART

Processes for producing phosphate layers on iron or steel surfaces by means of solutions of phosphoric acid containing various polyvalent metal cations and additives acting as accelerators (also called oxidants) are well established art. Such processes are used to achieve improved protection against corrosion, especially for automotive bodies. The phosphated surfaces are subsequently coated with paints, preferably by cathodic electrodeposition.

Materials commonly phosphated include most materials conventionally used in automotive body construction, such as iron or steel sheets, more recently also electrogalvanized or hot-galvanized steel, and materials having a surface composed of zinc alloys containing, for example, iron, nickel, cobalt or aluminum as alloying elements. Phosphating such surfaces for corrosion inhibition is usual not only in automobile manufacture but also in the manufacture of household appliances such as washing machines or refrigerators.

Prior to the phosphating treatment the work pieces are cleaned, rinsed and activated in order to obtain a thin and uniform phosphate layer, which is known to be one prerequisite for a good protection from corrosion. In the "high-zinc phosphating process" used for a long time it was possible in one process step to remove adherent oils, fats and other contaminants, including those due to machining, from the metal surface and at the same time to activate the metal surface for the following zinc phosphating step. Treatment baths for such a use have been described, for example, in the German Patent Specifications Nos. 2 951 600 and 3 213 649 as part of processes for pretreating metal surfaces prior to phosphating.

More recently, so-called "low-zinc" phosphating processes have been used to an increasing extent. Such processes are described, for example, in German Patent Specification No. 2 232 067. These processes, in combination with the usually following electrodeposited painting procedure, result in a clearly improved corrosion resistance. However, these processes are more sensitive to changes in the process parameters and to contaminants which are introduced into the phosphating bath with the sheets to be coated. Therefore, the step of activating the metal surface becomes much more significant than before. It has proven to be particularly advantageous to carry out the activation in a separate process step, subsequent to the step of cleaning and degreasing. This is all the more important if phosphating according to the low-zinc method is effected by a dipcoat procedure, but it is also true for zincphosphating by spraying or by combined spraying and dipcoating in either order.

The activation of the metal surface has the following objectives:

- Increase of the rate of formation of crystal nuclei and, hence, of the number of nuclei, in the initial phase of zinc phosphating, which results in layer refinement. The porosity of the desired zinc phosphate layer is reduced because the crystals are closely spaced. This results in the formation of a uniform and continuous zinc phosphate layer over the entire metal surface at a low surface area weight (indicated in grams of metal phosphate per 1 $m^2$ of metal surface), low surface area weights having proven to be beneficial as primer for paints
- Reduction of the minimum phosphating time, i.e., the time required to completely cover the metal surface with a continuous zinc phosphate layer.

These effects provided by the activating agent finally result in applied paint layers that are well anchored through the dense zinc phosphate layers containing fine particles and, thus, a good protection from corrosion will be attained, as is the main object of zinc phosphating.

As efficient activating agents having the required properties, the only known practical products have proven to be those which contain polymeric titanium-(IV) phosphate, such as those described by Jernstedt, for example in the U.S. Pat. Nos. 2,456,947 and 2,310,239. Today, these activating agents are preferably used in a separate rinsing bath immediately prior to the zinc phosphating step; however, they may also be added to a cleaning bath, preferably a mildly alkaline one, used at an earlier stage in the process. The essential step of the preparation procedure is the reaction (denoted as "aging" in part of the technical literature) of suitable titanium compounds, such as potassium hexafluorotitanate, with a large excess of phosphate components, preferably disodium hydrogen phosphate, at a temperature above 70 C ant at a pH value between 6 and 9.

Because the technical production of such activating agents of a consistent and high quality is difficult, there has been no lack of attempts to develop activating agents based on materials other than titanium phosphate.

Thus, Jernstedt describes activating agents based on zirconium phosphate or on reaction products of water-soluble tin and lead compounds with disodium hydrogen phosphate in U.S. Pat. Nos. 2,456,947 and 2,462,196. In German Patent Specification No. 29 31 712 there are described organic titanium compounds, which are stable against hydrolysis, as activating agents for zinc, zincmanganese, or manganese surfaces. These compounds are obtained by the reaction of a beta-diketone titanyl acetylacetonate with gluconic acid or gluconates in the presence of a hydrogen halide salt of an aliphatic aminoalcohol.

An additional option for increasing the rate of formation of nuclei on steel during phosphating is the treatment of the surface with diluted aqueous copper sulfate or copper nitrite solutions or with oxalic acid. However, the latter is effective only when controlled to produce slight etching of the iron surface; the activation effect will disappear if a continuous iron oxalate layer is formed (U.S. Pat. No. 2,164,024 and German Patent Specification No. 17 71 924).

European Patent Specification No. 0 056 675 describes a process for the pre-treatment of steel wire prior to zinc phosphating, using a bath containing sodium salts of oxalic, tartaric, or citric acids as activating agents.

In practice, so far none of these alternatives to titanium based activators has proven to be commercially successful.

It is an object of the present invention to provide practical titanium-free activating agents. More specifically, it is an object of the present invention to provide activating agents which form clear solutions in water and which contain a high amount of substances which are effective for the activation.

DESCRIPTION OF THE INVENTION

In this description, except in the operating examples or otherwise where explicitly stated to the contrary, all numbers describing amounts of materials or conditions of reaction or use are to be understood as modified by the term "about".

One embodiment of the invention is an activating composition, for the activation of surfaces of iron, steel, zinc, galvanized iron or steel, aluminum, its alloys, and steel coated with aluminum or its alloys prior to phosphating said surfaces with phosphating baths containing zinc ions, said activating composition comprising a product of reaction between:

1,1-diphosphonic acids and/or poly(aldehydocarboxylic acids) as complexing agents and phosphoric acids or alkali metal phosphates in the presence of water and in a mass ratio of complexing agent to phosphoric acid and/or alkali metal phosphate within the range of from 0.1:10 to 1:10, preferably within the range of from 0.2:10 to 0.5:10.

In this description, the term "complexing agent" is used to described the materials noted above and described in more detail below, because these materials are believed to be capable of forming complexes with a variety of polyvalent metal ions in aqueous solution. The term does not imply that these materials necessarily form complexes with alkali metal ions when such ions are used in the invention, because the molecular mechanism(s) behind the effective activating agents produced by reaction as described herein is unknown at present.

The phosphoric acids and alkali metal phosphates that, in some process embodiments of this invention, are to be reacted in the presence of water and at a pH value within the range of 6 to 12 with the complexing agents noted above, have been mentioned in German Unexamined Patent Application No. 37 31 049 and correspond to one of the following general formulas (I) to (III):

$$M_mH_{3-m}PO_4 \quad \text{(I)},$$

$$M_pH_{n+2-p}P_nO_{3n+1} \quad \text{(II), and}$$

$$(M_qH_{1-q}PO_3)_r \quad \text{(III)},$$

wherein

M: represents an alkali metal, m: represents 0, 1, 2 or 3, n: represents 2, 3 or 4, p: represents 0, 1, 2 . . . , or n+2, q: represents 0 or 1 and r: represents an integer of from 2 to 20.

In one preferred embodiment of the present invention, the phosphate component has the general formula (I) above. More preferably, the phosphate component is selected from the group of orthophosphoric acid, monoalkali metal dihydrogen orthophosphate, dialkali metal monohydrogen orthophosphate, and trialkali metal orthophosphate. The most preferred alkali metal in all the phosphate components of the invention is sodium.

In another preferred embodiment of the present invention, the phosphate component contains polyphosphates having the general formula (II) above. The group of compounds having the general formula (II) includes the so-called polyphosphoric acids which are formed when two or more molecules of orthophosphoric acid are condensed with removal of water to form molecules of the general formula (IIa)

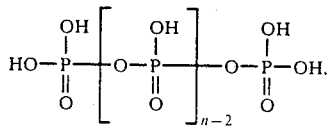

(IIa)

where n represents 2, 3, or 4.

In addition to the diphosphoric acids (n=2), triphosphoric acids (n=3), and tetraphosphoric acids (n=4) thus described by general formula IIa and useful in the invention, the alkali metals salts of the same acids are also useful It is preferred to use the sodium salts. Thus, in the general formula (II) any or all of the hydrogen atoms may be replaced by alkali metal atoms, and preferably by sodium atoms In still another preferred embodiment of the present invention, metaphosphoric acids or their salts having the general formula (III) are used. The free metaphosphoric acids (q=0) have cyclic structures known from prior art and are conventionally formed by further condensation reactions from the aforementioned polyphosphoric acids In such cyclic metaphosphoric acids, one or more of the hydrogen atom(s) bonded to oxygen atom(s) can be replaced by one or more alkali metal atom(s) to form metaphosphates. Again sodium is the preferred alkali metal atom.

Among the polyphosphates having the general formula (II) and metaphosphates having the general formula (III), those compounds of said general formulas wherein M represents sodium, n represents an integer of from 2 to 4 and r represents an integer of from 2 to 6 are most preferred.

The process according to the invention for making the activating compositions is carried out at temperatures within the range of from 75° C. to 120° C. Particularly preferred is a process in which the reaction is carried out at temperatures within the range of from 80° C. to 100° C.

Another preferred embodiment of the present invention is characterized by the use, as complexing agents, of materials selected from the group consisting of (a) poly(aldehydocarboxylic acids) obtainable by the reaction of hydrogen peroxide, acrolein, and acrylic acid, which have:

a viscosity number within the range of from 5 to 50 ml/g, an acid value within the range of from 450 to 670, an acid equivalent weight within the range of from 125 to 70, a setting point of less than 0° C., a content of carboxyl groups within the range of from 55 to 90% by mole, and a molecular weight within the range of from 1,000 to 20,000, and/or alkali metal salts of such acids, and (b) 1,1-diphosphonic acids, or salts of 1,1-diphosphonic acids, having the general formula (IV)

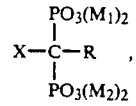

(IV)

wherein

R: represents either (i) a phenyl group which is unsubstituted or is para-substituted by halogen, amino, hydroxy, or $C_{1-4}$ alkyl groups, preferably by Cl or $NH_2$ or (ii) a straight-chain, branched or cyclic saturated or mono- or polyunsaturated alkyl group having from 1 to 10 carbon atoms;

X: represents hydrogen, hydroxy, halogen or amino; and $M_1$ and $M_2$ each independently represent hydrogen and/or an alkali metal ion.

In the processes according to the present invention particularly preferred complexing agents are 1,1-diphosphonic acids having the general formula (IV), wherein R represents an unbranched alkyl group having from 1 to 6 carbon atoms.

As the alkali metal salts of the poly(aldehydocarboxylic acids) and 1,1-diphosphonic acids there are preferably used the sodium salts, so that in the general formula (IV) M represents sodium.

The reaction of the complexing agent with alkali metal phosphate may usually be carried out in a kneading mixer to dryness or in an agitated tank with subsequent spray-drying. Accordingly, in a further preferred embodiment of the present invention, the reaction of complexing agent with alkali metal phosphate is carried out at temperatures within the range of from 75° C. to 120° C. in a kneading mixer to dryness or in an agitated tank with subsequent spray-drying. Particularly preferred is a process in which the reaction is carried out at temperatures within the range of from 80° C. to 100° C.

The process according to the invention allows a wide variation of the solids contents in the reaction. Accordingly, in a preferred embodiment of the process according to the invention, the solids content in the reaction is within the range of from 30 to 85%. In a particularly preferred embodiment, the solids content is within the range of from 75 to 85%, if the reaction is carried out in a kneading mixer. If the reaction is carried out in an agitated tank, it is particularly preferred that the solids content is within the range of from 30 to 40%.

In another preferred embodiment of the process according to the invention, up to 30% by weight of the total amount of complexing agent is added before or during the reaction of the complexing agent with alkali metal phosphate, and the remaining amount is incorporated in the reaction mixture only after a first initial drying of the product of the initial reaction to a residual moisture content of from 10 to 20%.

The activating agents according to this invention are normally used for the activation of metal surfaces prior to a zinc phosphating procedure, after adjusting solids content of the treatment composition into the range of from 0.001 to 10% by weight of the activating agents according to the invention, by mixing with water. Thus, the present invention further relates to the use of the titanium free activating agents according to the invention in the form of aqueous dispersions as agents for activating surfaces of iron, steel, zinc, galvanized iron or steel, aluminum, its alloys, and steel coated with aluminum or its alloys, prior to phosphating said surfaces with phosphating baths containing zinc ions.

A further preferred embodiment of the present invention consists of the use of the titanium free activating agents according to the present invention in the form of aqueous dispersions as activating agents prior to a low-zinc phosphating procedure.

Some poly(aldehydocarboxylic acids) useful according to the invention are commercially available and are marketed, for example, by Degussa AG, Frankfurt (West Germany) under the designations POC OS 20, POC HS 0010, POC HS 2020, POC HS 5060, POC HS 65 120 and POC AS 0010, POC AS 2020, POC AS 5060, or POC AS 65 120. In these names, the designation HS refers to the acid form, and the designation AS refers to the sodium salt form of the poly(aldehydocarboxylic acids). They may be prepared by a specific process developed by the company Degussa, the "oxidative polymerization" of acrolein. In said process, acrolein alone or in admixture with acrylic acid in an aqueous solution is treated with hydrogen peroxide. The $H_2O_2$ acts as a polymerization initiator and a molecular weight modifier. At the same time part of the aldehyde groups of the acrolein is oxidized by hydrogen peroxide to form carboxyl groups. Thereby polymers are formed which have pendant aldehyde and carboxyl groups, namely the poly(aldehydocarboxylic acids).

Information about the above-described preparation of the poly(aldehydocarboxylic acids) and about possible uses thereof are found in a company brochure by DEGUSSA AG under the title "POC-Umweltfreundliche Polycarbonsäuren mit vielfältigen Anwendungsmöglichkeiten", with printing note: CH 215-3-3-582 Vol. In accordance therewith, the poly(aldehydocarboxylic acids) may be used, for example, as hardness stabilizers, which inhibit precipitation of calcium and other alkaline earth metal salts, as inhibitors of deposit formation in sea water deionizing, as dispersing agents for aqueous pigment dispersions which are concentrated in solids, and as builders for washing and cleansing agents. Furthermore in this company brochure there may be found indications of correspondingly relevant patent literature, for example German Patent Specification No. 10 71 339 (preparation), German Unexamined Patent Application No. 19 04 940 (complex-forming agents), German Unexamined Patent Application No. 19 04 941 (polyoxycarboxylic acids), German Patent Specification No. 19 42 556 (complex-forming agents), German Unexamined Patent Application No. 21 54 737 (rust-preventive treatment), German Unexamined Patent Application No. 23 30 260 and German Patent Specification No. 23 57 036 (preparation).

The poly(aldehydocarboxylic acids) contain moieties of aldehydocarboxylic acids which have been mostly linearly linked via carbon-carbon bonds and have many pendant carboxyl groups, relatively few pendant aldehydo groups, and terminal hydroxyl groups. The chemical constitution thereof is more specifically characterized by the generalized formula (V), in which x, y, and p are all integers.

$$HO[(CH_2-\underset{\underset{COOH}{|}}{CH})_x(CH_2-\underset{\underset{CHO}{|}}{CH})_y]_p-OH \quad (V)$$

However, the steric linkage of the monomer constituents is believed to be atactic, and the sequence of linkage is believed to be random.

The contents of carboxyl and aldehydo groups and the average molecular weight of the various grades of poly(aldehydocarboxylic acids) may be varied by selecting suitable reaction conditions.

The average degrees of polymerization are indicated by the viscosity numbers. These are usually between 5 and 50 ml/g, based on 100% solids, measured as a 2% solution in 0.1N NaBr at 25° C. and a pH of 10 in an Ubbelohde viscosimeter, capillary No. 0a. The content of carboxyl groups, expressed herein as mole % COOH out of the total of —COOH and —CHO, may be calculated from the acid value (DIN 53402) of the dried polymers The acid value of aqueous poly(aldehydocarboxylic acids) is generally unsuitable for calculating the molar percentage of COOH, because the technical grades normally used contain minor amounts of formic acid, acetic acid and β-hydroxypropionic acid as by-products.

The free poly(aldehydocarboxylic acids) can be neutralized with alkali solutions to form the corresponding salts, e.g. with NaOH to form sodium poly(aldehydocarboxylates). The sodium poly(aldehydocarboxylates) will have to be converted into the H form by ion exchange prior to the determination of the acid value.

Surprisingly, it has now been found that compositions prepared as described above are at least equivalent to prior art agents containing titanium phosphate.

A particularly preferred complexing agent is 1-hydroxyethane-1,1-diphosphonic acid (HEDP), used with monomeric or oligomeric alkali orthophosphates; if required, the pH of the aqueous reaction mixture is adjusted to the range between 7.5 and 9. With the particularly preferred use of disodium hydrogen phosphate, a pH adjustment is unnecessary.

The novel activating agents of this invention, like the conventional agents containing titanium phosphate, are normally used in an aqueous preparation containing about 0.2% by weight of the activating agents. They then form clear solutions. This means an practical advantage over the titanium phosphate-based conventional agents which, due to their low solubility, can be used only as milky turbid suspensions. These suspensions usually contain a considerable portion of coarse particles which are ineffective for the activation.

A crucial step in the preparation of the novel titanium-free activating agent is the reaction of the complexing agent with the alkali metal phosphate at a temperature in excess of 70° C., and preferably between 80° C. and 100° C., in the presence of water. Simply mixing the complexing agent with an aqueous phosphate solution does not produce the desired result.

The reaction, when there is a high solids contents in the reaction mixture, advantageously may be carried out in a kneading mixer. In this method, a blend of 20 to 25 parts by weight of fully deionized water, 70 to 79 parts by weight of phosphate, preferably disodium hydrogen phosphate, and 1 to 4 parts by weight, preferably 1 to 2 parts by weight, of complexing agent are kneaded together under the temperature conditions as indicated to dryness of the reaction mixture, i.e., until the residual moisture is about 2%. It may be particularly advantageous in the beginning of the reaction to add only about one fourth of the predetermined amount of complexing agent and to add the remainder after the reaction mixture has been initially dried to a residual moisture of between 10 and 20%.

The practice of the invention may be further appreciated from the following operating examples.

EXAMPLES

In order to determine the activating effect provided by the activating agents prepared according to the invention and by products used for comparison, the surfaces of steel specimens (material St 1405m, dimensions 10 cm×20 cm, about 1 mm in thickness) were phosphated by means of a standardized dipcoat phosphating process according to Table 1. The process was selected so that the influence of the activating agents on the area weights and morphology of the zinc phosphate layer and the capacity of the activating aqueous preparation were elucidated under standard conditions.

The "area weight" of the metal phosphate layer is understood to mean the mass of the coating divided by its area and is expressed in grams per square meter and determined according to DIN 50 492.

For the determination of the bath capacity, two liters of a 0.2% aqueous preparation of the activating agent was used in each case for a group of test sheets which were subsequently phosphated. The average area weights of four consecutive test specimens were determined initially and after every tenth test sheet in each group of test sheets. The average values calculated therefrom are set forth in Table 2. The baths were considered to have been exhausted, when ten consecutive sheets in a group, upon being zinc phosphated, exhibited defects or coarsely crystalline regions. The bath capacity is expressed as square meter of activatable area per two liters of activating bath.

COMPARATIVE EXAMPLE 1

For comparison with the invention, a commercially available activating agent from Gerhard Collardin GmbH, Cologne, West Germany, specifically Fixodine® 6, was used. The results of the activation attained therewith are compared in Table 2 to those produced by the activating agents according to the invention (Examples 1 to 7).

EXAMPLES 1 TO 7

For the preparation of the activating agents the starting compounds were reacted in the ratios indicated in Table 2. The procedure is described below in detail for Example 1; it was varied in a way known to those skilled in the art to accommodate the variations in amounts of ingredients in the other Examples 2–7.

The 1-hydroxyethane-1,1-diphosphonic acid (HEDP) was supplied as a 60% by weight aqueous solution under the name Turpinal® SL by Henkel KGaA, Düsseldorf; the amounts specified below, however, are for the active ingredient.

A laboratory kneading mixer having sigma blades was charged with 171.4 g of fully deionized (DI) water at 80° C., and 366 g (=⅔ of the total amount) of $Na_2HPO_4$ were mixed therewith. Then, 2.9 g of HEDP were added, and the mixture was kneaded for 15 minutes.

Thereafter, the residual amount (183.3 g) of the $Na_2HPO_4$ was added, and the product was kneaded until drying began. Then 11.5 g of HEDP were further added, and the mixture was kneaded to dryness.

Table 2 shows the results of the activation for a normal-zinc dipcoat phosphating process. Example 3 in Table 2 reveals the significant decrease in the activation performance, specifically a large increase in coating weight, if the ratio of amounts of the complexing agent to phosphate exceeds the preferred value of 5:100.

COMPARATIVE EXAMPLE 2

For the purpose of comparison with the product of Example 1 according to the invention, 3.9 g of $Na_2HPO_4$ and 0.1 g of HEDP were dissolved in 2.0 l of water to produce a bath containing amounts of materials similar to that of Example 1. The sheets phosphated after activation with this solution showed passivation phenomena, stains, and coarse crystals and, hence, a totally inadequate activation. This finding underscores the importance of the method of preparation of the activating agents according to the invention.

EXAMPLE 8

Table 3 shows the procedures for a spray phosphating process. As the product for comparison, Fixodine ® 6 was again used. The results show that the performance of the product of Example 1 according to the invention (Table 2) is as good as the standard product; the product according to the invention resulted in an area weight of 3.01 g/m², while the commercially available product gave an area weight of 3.07 g/m².

TABLE 1

Treatment steps in the standard phosphating process

| Stage | Treatment step | Treatment with | Concentration % by weight | Temperature (°C.) | Period of Treatment (min) |
|---|---|---|---|---|---|
| 1 | Mechanical cleansing and degreasing | absorbent paper | — | 20 | 5 |
| 2 | Chemical cleansing and degreasing | Ridoline ® C 1051[1] | 5 | 80–90 | 5 |
| 3 | Rinsing | Tap water[2] | — | 20 | 1 |
| 4 | Pickling | Chemapix ® ACM[3] | 30 | 20 | 1 |
| 5 | Rinsing | Tap water[2] | — | 20 | 1 |
| 6 | Activation | Activating agent according to Table 2 | 0.2 | 20 | 2 |
| 7 | Phosphating | Granodine ®[4] | 3.0 | 60–70 | 5 |
| 8 | Rinsing | DI water[5] | — | 20 | 1 |
| 9 | Drying | Compressed air | — | 20 | to dryness |

[1]Commercially available, strongly alkaline, phosphate-containing immersion cleaner, from Gerhard Collardin GmbH, Cologne, West Germany

[2]Untreated city water of 18° German hardness

[3]Commercially available rust-removing and descaling agent containing hydrochloric acid and inhibitor, from Gerhard Collardin GmbH, Cologne, West Germany

[4]Commercially available nitrate/nitrite accelerated phosphating agent, from Gerhard Collardin GmbH, Cologne, West Germany

[5]Fully deionized water.

TABLE 2

Composition and performance parameters of activating agents

| Example | Complexing substance Type | Amount (%)[1] | $Na_2HPO_4$[2] (%) | Area Weight[3] | Capacity[4] |
|---|---|---|---|---|---|
| Compar. 1 | — | No additive (Fixodine ® 6) | | 2.2 | 1.7 |
| 1 | 1-Hydroxyethane-1,1-diphosphonic acid | 0.38 + 1.59 | 74.8 | 2.5 | 3.2 |
| 2 | same | 0.38 + 2.62 | 74.0 | 2.7 | — |
| 3 | same | 0.38 + 7.06 | 70.6 | 4.2 | — |
| 4 | same (process in stirred flask) | 0.38 + 0.48 | 33.2 | 2.5 | — |
| 5 | 1-Hydroxyhexane-1,1-diphosphonic acid | 0.38 + 2.12 | 74.4 | 3.0 | — |
| 6 | 1-Hydroxy-1-phenylmethane-1,1-diphosphonic acid | 0.38 + 1.59 | 74.8 | 3.0 | — |
| 7 | Poly(aldehydocarboxylic acid) POC HS 5060 | 0.38 + 1.59 | 74.8 | 3.2 | 2.2 |

[1]First number: amount added (% by weight) in the beginning of the reaction; second number: amount added after initial reaction and drying of the reaction product.

[2]Percentage of the total of the mixture of reactants prior to reaction; the balance to 100% of the indicated amounts in fully deionized water.

[3]Average area weight (g/m²), determined in accordance with the description in the text; also see note 4.

[4]Activatable area (in m²) per 2 liters of activating baths containing 0.2% by weight of the activating agent. Where no figure appears, the capacity was not determined, and in this case the area weight indicated is the average weight of three test sheets.

TABLE 3

Course of the procedure for testing the activation in a "low-zinc" phosphating process GRANODINE ® SP 2500/Spray application

| Stage | Treatment step | Product | Concentration (% by weight) | Temperature (°C.) | Period of Treatment (min) |
|---|---|---|---|---|---|
| 1 | Pre-cleaning | Ridoline ® C 1250[1] | 0.5 | 60 | 0.5 |
| 2 | Cleaning | Ridoline ® C 1250[1] | 0.5 | 55 | 2.0 |
| 3 | Rinsing | Tap water[2] | — | 30 | 0.5 |
| 4 | Activating | see Example 8 | 0.1 | 25 | 1.0 |
| 5 | Phosphating | GRANODINE ® SP 2500[3] | 4.2 | 52 | 1.5 |
| 6 | Rinsing | Tap water[2] | — | 35 | 0.5 |
| 7 | Rinsing | Fully deionized water | — | 20 | 0.5 |
| 8 | Drying | Hot air | — | 75 | 10 |

[1]Medium-alkaline phosphate/borate-containing spray/immersion cleaner supplied by Gerhard Collardin GmbH, Cologne, West Germany.
[2]City water of 28° German hardness.
[3]Chlorate/nitrate-accelerated "low zinc"-phosphating agent supplied by the Gerhard Collardin, Cologne, West Germany.

What is claimed is:

1. A titanium-free composition for the activation of metal surfaces prior to phosphating said surfaces with phosphating baths containing zinc ions, said composition comprising a product of reaction, in the presence of water and at a temperature within the range of about 75 to about 120 C, between (A) ingredients selected from the group of 1,1-diphosphonic acids and alkali metal salts thereof and (B) phosphoric acids and their alkali metal salts, components (A) and (B) being reacted at a weight ratio within the range of from about 0.1:10 to about 1:10.

2. A composition according to claim 1, wherein components (A) and (B) are reacted at a weight ratio within the range of from about 0.2:10 to about 0.5:10.

3. A composition according to claim 2, wherein (I) the 1,1-diphosphonic acids and salts of part (A)(a) have structures according to the general formula (IV)

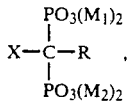

(IV)

wherein

R: represents a phenyl group which is unsubstituted or para-substituted by halogen, amino, hydroxy or $C_{1-4}$ alkyl groups; or a straight-chain, branched, or cyclic saturated or mono- or polyunsaturated alkyl group having from 1 to 10 carbon atoms, X: represents hydrogen, hydroxy, halogen or amino and $M_1$ and $M_2$ each independently represent hydrogen or the equivalent of an alkali metal ion.

4. A composition according to claim 3, comprising activating agents produced by reaction of 1,1-diphosphonic acids having the general formula (Iv), when R represents an unbranched alkyl group having from 1 to 6 carbon atoms.

5. A composition according to claim 3, comprising activating agents produced by reacting sodium salts as components (A).

6. A composition according to claim 3, wherein the alkali metal phosphates reacted correspond to one of the general formulas (I), (II), or (III):

$$M_mH_{3-m}PO_4 \quad (I)$$

$$M_pH_{n+2-p}P_nO_{3n+1} \quad (II)$$

$$(M_qH_{1-q}PO_3)_r \quad (III),$$

wherein

M: represents an alkali metal, m: represents 0, 1, 2 or 3, n: represents 2, 3 or 4, p: represents 0, 1, 2 . . . , n+2, q: represents 0, or 1, and r: represents an integer of from 2 to 20.

7. A composition according to claim 6, wherein m is not 0 and M represents sodium.

8. In a process comprising activating surfaces of iron, steel, zinc, galvanized iron or steel, aluminum, its alloys, and iron or steel coated with aluminum or its alloys and subsequently phosphating said surfaces with phosphating baths containing zinc ions, the improvement wherein activating is accomplished by contacting the surfaces with an aqueous dispersion of a product of reaction, in the presence of water and at a temperature within the range of about 75 to 120 C, between (A) ingredients selected from the group of 1,1-diphosphonic acids and alkali metal salts thereof and (B) phosphoric acids and their alkali metal salts, components (A) and (B) being reacted at a weight ratio within the range of from about 0.1:10 to about 1:10.

9. A process according to claim 8, wherein (I) the 1,1-diphosphonic acids and salts of part (A)(a) have structures according to the general formula (IV)

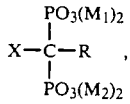

(IV)

wherein

R: represents a phenyl group which is unsubstituted or para-substituted by halogen, amino, hydroxy or $C_{1-4}$ alkyl groups; or a straight-chain, branched, or cyclic saturated or mono- or polyunsaturated alkyl group having from 1 to 10 carbon atoms, X: represents hydrogen, hydroxy, halogen or amino and $M_1$ and $M_2$ each independently represent hydrogen or the equivalent of an alkali metal ion.

10. A process according to claim 9, wherein the phosphoric acids and alkali metal phosphates reacted correspond to one of the general formulas (I), (II), or (III):

$$M_mH_{3-m}PO_4 \quad (I)$$

$M_pH_{n+2-p}P_nO_{3n+1}$ (III), $(M_qH_{1-q}PO_3)_r$ (III), wherein

M: represents an alkali metal, m: represents 0, 1, 2 or 3, n: represents 2, 3 or 4, p: represents 0, 1, 2 . . . , or n+2, q: represents 0 or 1, and r: represents an integer of from 2 to 20.

11. A process according to claim 9, wherein the components reacted from part (A) are sodium salts.

12. A process according to claim 11, wherein the phosphating step is low-zinc phosphating.

13. A process according to claim 10, wherein the phosphating step is low-zinc phosphating.

14. A process according to claim 9, wherein the phosphating step is low-zinc phosphating.

* * * * *